US006150758A

United States Patent [19]

Tamura

[11] Patent Number: 6,150,758

[45] Date of Patent: Nov. 21, 2000

[54] NOBLE GAS DISCHARGE LAMP HAVING EXTERNAL ELECTRODES WITH FIRST AND SECOND OPENINGS AND A SPECIFIED AMOUNT OF FLUORESCENT COATING MATERIAL

[75] Inventor: Satoshi Tamura, Osaka, Japan

[73] Assignee: NEC Corporation, Japan

[21] Appl. No.: 09/046,925

[22] Filed: Mar. 24, 1998

[30] Foreign Application Priority Data

Mar. 25, 1997 [JP] Japan ..... 9-072054
Mar. 25, 1997 [JP] Japan ..... 9-072071

[51] Int. Cl.[7] ..... H01J 1/62; H01J 63/04; H01J 11/00; H01J 65/00; H01J 61/06

[52] U.S. Cl. ..... 313/488; 313/234; 313/491; 313/594; 313/607; 313/631; 313/632

[58] Field of Search ..... 313/491, 493, 313/567, 631–32, 634–35, 637, 643, 234, 607, 484–85, 488, 594, 595, 596, 597, 598, 599, 600, 601, 602

[56] References Cited

U.S. PATENT DOCUMENTS 4,871,941 10/1989 Dobashi et al. ..... 313/485
5,117,160 5/1992 Konda et al. .
5,886,468 3/1999 Terada et al. ..... 313/234 X
5,903,095 5/1999 Yoshida et al. ..... 313/607 X

FOREIGN PATENT DOCUMENTS 0329226 8/1989 European Pat. Off. .
0497360 8/1992 European Pat. Off. .
8910046 10/1989 WIPO .

OTHER PUBLICATIONS

Patent Abstracts of Japan Publication No. 55003116, publication date Oct. 1, 1980, Applicant, Matsushita Electric Works Ltd., Inventor, Hashimoto Noboru, Title "Fluorescent Lamp".

*Primary Examiner*—Nimeshkumar D. Patel
*Assistant Examiner*—Mack Haynes
*Attorney, Agent, or Firm*—Ostrolenk, Faber, Gerb & Soffen, LLP

[57] ABSTRACT

A noble gas discharge lamp of the present invention comprises an outer enclosure comprising a light emitting layer comprising at least one fluorescent substance, the light emitting layer formed therein and a pair of outer electrodes having tape shapes comprise a metal, which are adhered to the entire length of the outside of the outer enclosure so as to separate one outer electrode and the other outer electrode at a certain distance, and to form a first opening portion and a second opening portion; wherein the coated amount of fluorescent substance is in a range of 5 to 30 mg/cm$^2$.

10 Claims, 6 Drawing Sheets

NOBLE GAS DISCHARGE LAMP HAVING EXTERNAL ELECTRODES WITH FIRST AND SECOND OPENINGS AND A SPECIFIED AMOUNT OF FLUORESCENT COATING MATERIAL

BACKGROUND OF THE INVENTION

1. Field of the Invention

The present invention relates to a noble gas discharge lamp. More particularly, the present invention relates to a noble gas discharge lamp comprising a light emitting layer comprising an aperture inside a glass bulb, and a pair of outer electrodes in the shape of a belt outside the glass bulb; in which the light emitting layer is improved so as to increase the light output, and can produce a stable travel of electric discharge.

This application is based on patent applications Nos. Hei 9-72054 and Hei 9-72071 filed in Japan, the content of which is incorporated herein by reference.

2. Description of the Related Art

The applicant of the present invention previously proposed the noble gas discharge lamp shown in FIGS. 8 to 10. In FIGS. 8 to 10, reference number 1 indicates an airtight outer enclosure in the shape of a straight tube, and is comprised of as a glass bulb, for instance. On the inside of the outer enclosure 1, a light emitting layer 2 is formed which is comprised of one or more kinds of fluorescent substances, such as fluorescent rare earth substances, and fluorescent halorine acid salt substances. In particular, an aperture 2*a* having a certain opening angle is formed to extend over the full length of the light emitting layer 2.

The outer enclosure 1 is sealed by adhering glass plates in the shape of a disc to the ends of the glass bulb. However, for example, the outer enclosure 1 can also be sealed by tapering and cutting the ends of the glass bulb, while heating.

Moreover, the internal part of the outer enclosure 1 is filled with one kind of noble gas such as xenon (Xe), krypton (Kr), neon (Ne), helium (He), and the like, or a mixture thereof in which a metallic vapor such as mercury is not contained. Among these noble gases, noble gas comprising xenon as a main component is preferable.

An outer laminate 3 is rolled closely into the outside of the outer enclosure 1. The outer laminate 3 may be composed of a light transmitting sheet 4, a pair of outer electrodes 5 and 6, terminals 51 and 61, and an adhesive layer 9.

The light transmitting sheet 4 has a length equal to a length of the outer enclosure 1, and a thickness in a range of 20 to 100 microns. This light transmitting sheet 4 may be suitably comprised of polyethylene terephtalate (PET); however, polyester resin can be also used.

The above-mentioned pair of outer electrodes 5 and 6 are comprised of a metallic member having a light insulating property, the appearance thereof is tape shape, and it is adhered to one surface of the light transmitting sheet 4 so as to separate one outer electrode 5 from the other outer electrode 6 at a certain interval.

The terminals 51 and 61 are connected electrically to the ends of the outer electrodes 5 and 6. They are arranged at the edge of the light transmitting sheet 4 so that the ends thereof project from the edge of the light transmitting sheet 4. The thickness of the terminals 51 and 61 is preferably in a range of 0.1 to 0.5 mm.

The outer electrodes 5 and 6 and the terminals 51 and 61 are comprised of metals having differing corrosion potentials; for instance, aluminum foil in the shape of a tape is suitable for the outer electrodes 5 and 6. In addition to aluminum, nickel and other metals which have excellent electroconductivity and light insulating properties can comprise the outer electrodes 5 and 6. Regarding the terminals 51 and 61, copper in the shape of a strip is suitable. However, in addition to copper, metals such as silver, stainless steel, Cu-Ni alloy, and the like can comprise the terminals 51 and 61.

In particular, in the relationships of the widths between the outer electrodes 5 and 6 and the terminals 51 and 61, the width (w) of the outer electrodes 5 and 6, and the width (d) of the terminals 51 and 61 are preferably satisfied with the formula: $0.1\ w \leqq d \leqq 0.5\ w$.

The adhesive layer 9 has sticky properties and/or adhesive properties, and is adhered to one surface of the light transmitting sheet 4. The adhesive layer 9 is suitably comprised of a silicon adhesive agent; however, acryl resin adhesive agents and the like can also be used.

Moreover, plating layer (not shown in the Figures) is formed on terminals 51 and 61. The plating layer is comprised of metals which are different from metals comprising the outer electrodes 5 and 6 and the terminals 51 and 61, and which the corrosion potential difference is between the corrosion potential differences of the metals comprising the outer electrodes 5 and 6 and the terminals 51 and 61. For instance, in the case in which the outer electrodes 5 and 6 are comprised of aluminum foil, and the terminals 51 and 61 are comprised of copper, nickel, and lead-tin solder can be listed metals suitable for comprising the plating layer.

The plating layer can be formed preferably by electroplating or electroless plating; however, the plating layer can also be formed by an immersion or a flame spray.

The thickness of the plating layer is preferably in a range of 5 to 30 microns, more preferably in a range of 10 to 20 microns. However, a plating layer having a thickness outside the range can also be used.

The aforementioned outer laminate 3 is formed onto the outside of the outer enclosure 1 so that the outer electrodes 5 and 6 are positioned between the outer enclosure 1 and the light transmitting sheet 4. One edge 4*a* of the light transmitting sheet 4 is laminated and adhered to the other edge 4*b* at the following second opening portion 8. Moreover, a first opening portion 7 is positioned at one ends of the outer electrodes 5 and 6, and the second opening portion 8 is positioned at the other ends of outer electrodes 5 and 6. The light from the light emitting layer 2 is emitted mainly from the first opening portion 7 via the aperture 2*a*.

The noble gas discharge lamp comprising the above-mentioned components can be produced by the following steps.

A water soluble fluorescent paint is made by mixing water soluble fluorescent substances having an emission spectrum in a blue range, a green range, and a red range, for example. Next, the light emitting layer 2 is formed by coating a water soluble fluorescent paint on the inside of the outer enclosure 1 comprised of a glass bulb, by drying and then firing.

The aperture 2*a* is formed by peeling off and by forcibly removing a part of the light emitting layer 2, while maintaining a certain opening angle, by using a scraper (not shown in Figures). The obtained outer enclosure 1 is sealed and is filled with a certain amount of noble gas such as xenon and the like.

As shown in FIGS. 9 and 10, the outer laminate 3 is formed by positioning one pair of the outer electrodes 5 and 6 on the light transmitting sheet 4 so as to be disposed with a certain space therebetween, so that the terminals 51 and 61 project out from the edges of the outer electrodes 5 and 6, and by forming the adhesive layer 9 onto the upper surfaces of the light transmitting sheet 4 and the outer electrodes 5 and 6.

As shown in FIG. 11, the unfolding outer laminate 3 obtained by the above-mentioned steps is positioned on the stage 10. The outer enclosure 1 is positioned on the outer laminate 3 so that the outer enclosure 1 is positioned on the edge 4*a* of the light transmitting sheet 4, and the longitudinal axis of the outer enclosure 1 is parallel to the longitudinal axis of the outer electrodes 5 and 6. Rollers 11 and 11 are positioned so that the outer enclosure 1 is contacted with some pressure to the light transmitting sheet 4, while maintaining the above conditions.

While maintaining the above conditions, as shown in FIG. 11, the stage 10 is moved in the direction M, and is then moved in the direction N. Because of these movements, the outer laminate 3 is wound around the outside of the outer enclosure 1, and one edge 4*a* is piled on the other edge 4*b* of the light transmitting sheet 4, as shown in FIG. 8. Then, the noble gas discharge lamp is produced by adhering the edges 4*a* and 4*b* of the light transmitting sheet 4 with the adhesive layer 9.

The resulting noble gas discharge lamp is switched on to produce light by applying a high voltage of high frequency (for example, a frequency of 30 kHz and a voltage of 2500 $V_{o\text{-}p}$) to the outer electrodes 5 and 6, from an inverter circuit 12, via the terminals 51 and 61. Light is emitted from the first opening portion 7 via the aperture 2*a*.

For instance, the voltage applied to the outer electrodes 5 and 6 is approximately 2500 $V_{o\text{-}p}$ in a noble gas discharge lamp of which the outer enclosure 1 is 8 mm in external diameter and 360 mm in total length.

In particular, mercury is not included in this noble gas discharge lamp; therefore, large amounts of light are generated instantaneously when the lamp is lit. That is, light increases to full quantity (approximately 100%) as soon as the lamp is lit. Moreover, light quantity and discharging voltage of the obtained noble gas discharge lamp are not influenced by the surrounding temperature. Therefore, when the noble gas discharge lamp is used in illumination scanning devices, for instance, the illumination intensity on a scanned document can be raised, and therefore, scanning precision of the scanned document can be improved.

Moreover, it is anticipated that the noble gas discharge lamp will have the following effects. The plating layer is formed between the outer electrodes 5 and 6 and the terminals 51 and 61; therefore, even if the outer electrodes 5 and 6 and the terminals 51 and 61 which are comprised of metals having different corrosion potential differences each other, are connected directly generation of corrosion due to the contact of different kinds of metal can be prevented.

In particular, when the width (w) of the outer electrodes 5 and 6 and the width (d) of the terminals 51 and 61 are set to satisfy the following formula: $0.1\,w \leqq d \leqq 0.5\,w$, corrosion due to contact of different kinds of metal can be prevented, in company with the existence of the plating layer. Therefore, stable travel of electric discharge of the noble gas discharge lamp can be maintained for long periods.

However, when the width (d) of the terminals 51 and 61 is less than 0.1 w, contact intensity to the outer electrodes 5 and 6 of the terminals 51 and 61 is decreased. In contrast, when the width (d) of the terminals 51 and 61 is more than 0.5 w, in winding the outer laminate 3 around the outside of the outer enclosure 1, the terminals 51 and 61 could not be wound around the outside of the outer enclosure 1 more easily. This process is extremely troublesome. Therefore, it is preferable that width (w) of the outer electrodes 5 and 6 and the width (d) of the terminals 51 and 61 satisfy the above-mentioned formula.

Moreover, the following effects can be obtained in the process for products. The adhesive layer 9 is formed on one surface of the light transmitting sheet 4; therefore, the outer laminate 3 can be adhered closely to the outside of the outer enclosure 1 by a simple step, that is, simply by rolling the outer enclosure 1 onto the outer laminate 3. In addition, the outer electrodes 5 and 6 are positioned previously so as to be disposed at a certain interval from each other on the light transmitting sheet 4; therefore, in adhering the outer laminate 3 to the outer enclosure 1, it is not necessary to adjust the positioning of the outer electrodes 5 and 6 to maintain a certain interval therebetween. Therefore, it can be anticipated that not only will the work efficiency be greatly improved, but automated production of the noble gas discharge lamp is also possible. That is, production of the noble gas discharge lamp in large quantities may be anticipated.

As described above, when the noble gas discharge lamp is used in a scanning device, the irradiance of the emitted light from the light emitting layer 2 can be high due to the existence of the aperture 2*a*. Therefore, the intensity of illumination on a document being scanned may be increased. As a result, accurate scanning of documents can be ensured.

However, in recent years, in order to manage a business with high efficiency, improvement in feeding speed of documents in office automation device is desired. At high speeds the scanning accuracy of documents (the resolution) tends to decrease.

In order to scan documents at high feeding speeds, it is preferable to increase the light output to increase the illumination intensity on the illuminated document. For example, the diameter of the outer enclosure 1 may be increased, and the electrical power input to the noble gas discharge lamp may be increased, easily increasing the light output. However, the interval between the surface of the illuminated document and this noble gas discharge lamp is narrower, such as 6 to 12 mm, in an illuminating device. Therefore, it is difficult to dispose the noble gas discharge lamp comprising an outer enclosure 1 having a larger diameter than that range.

When the electrical power to be input to the noble gas discharge lamp is increased without a change in size thereof, it is possible to increase the emitting light quantity in proportion to the increase of electrical power. However, the rate of increase in the light emitting quantity is small in proportion to the increase of input electrical power. It is therefore impossible to obtain an illumination intensity on an illuminated document sufficient to ensure full scanning accuracy.

Moreover, this noble gas discharge lamp is different from lamps having one discharge along the longitudinal direction of the outer enclosure 1, such as a noble gas discharge lamp having a hot cathode or a cold cathode. More specifically, innumerable discharges occur between the outer electrodes 5 and 6 (discharges are generated approximately perpendicularly to the longitudinal direction of the outer enclosure 1); therefore, when such a light is turned on, light is emitted in a striped pattern in the above-mentioned noble gas discharge lamp. Electric discharges in a striped pattern cannot be comfirmed under normal lighting conditions.

However, when the output electric power from the inverter circuit 12 is decreased 10%, for example, by a change of voltage from a power source, the electric discharges in a striped pattern can be confirmed. Moreover, the electric discharging positions (points) are not stable and travel in the longitudinal direction of the outer enclosure 1, without interruption. The light emitting from aperture 2*a* therefore becomes intermit. As a result, the illumination intensity on the illuminated document decreases.

In particular, in the case of employing the noble gas discharge lamp in the illumination device for the office equipment such as facsimile machines, image-scanners, and the like, the light intensities at the points in the longitudinal direction of the aperture 2*a* change continuously. Therefore, it is possible that the scan accuracy of the illuminated document is extremely degraded, and the quality of reproduction is also degraded.

SUMMARY OF THE INVENTION

It is therefore an object of the present invention to provide a noble gas discharge lamp having simple constructions, which lamps improving light output and can produce a stable travel of electric discharge without changing the size of the outer enclosure and the electrical input.

According to an aspect of the present invention, the present invention provides a noble gas discharge lamp comprising of : an outer enclosure comprising a light emitting layer comprising at least one kind of fluorescent substance, the light emitting layer formed therein, and a pair of outer electrodes in the shape of a tape comprising a metal, which are adhered to the total length of the outside of the outer enclosure so as to be separated at a certain interval, and to form a first opening portion and a second opening portion, wherein the coated amount of the fluorescent substance is in a range of 5 to 30 mg/cm$^2$.

As stated above, the coated amount of the fluorescent substance is in a range of 5 to 30 mg/cm$^2$; therefore, in the noble gas discharge lamps of the present invention, the light output from the first opening portion can be effectively improved, without changing the size of the outer enclosure or the electrical input. Therefore, in employing the noble gas discharge lamp in illumination devices for office equipment, the illumination intensity on the illuminated document can be improved. As a result, it can be anticipated that high scanning accuracy will be obtained even if the document feeding speed is increased.

In particular, when the width of the outer electrodes is fixed, the opening angle $\theta_1$ of the first opening portion is set to be in a range of 60 to 110°; when the distance between one outer electrode and the other electrode in the second opening portion is 2 mm, the opening angle $\theta_1$ of the first opening portion is set to be in a range of 60 to 120°, the light output emitted from the first opening portion can be further improved when the coated amount of the fluorescent substance is set to be in a range of 5 to 30 mg/cm$^2$.

Moreover, the opening angle $\theta_1$ of the first opening portion is larger than the opening angle $\theta_2$ of the second opening portion; therefore, the loss of light caused by the leakage of the light from the second opening portion can be reduced. As a result, the light output from the first opening portion can be improved.

Moreover, when the opening angle $\theta_1$ of the first opening portion is larger than the opening angle $\theta_2$ of the second opening portion, and the distance between one outer electrode and the other electrode in the second opening portion is 2 mm or greater simultaneously, not only can the loss of light caused by the leakage of light from the second opening portion be decreased, but also the destruction of insulation in the second opening portion can be prevented. As a result, stable travel of discharges in the noble gas discharge lamp can be obtained.

In addition, when light reflective properties are given to the inside of the outer electrodes in which the outer electrodes contact the outer enclosure, the light output from the first opening portion can be further improved with the above-mentioned constructions.

DESCRIPTION OF THE PREFERRED EMBODIMENTS

A detailed explanation will now be made of the noble gas discharge lamp of the present invention.

Figure 8:
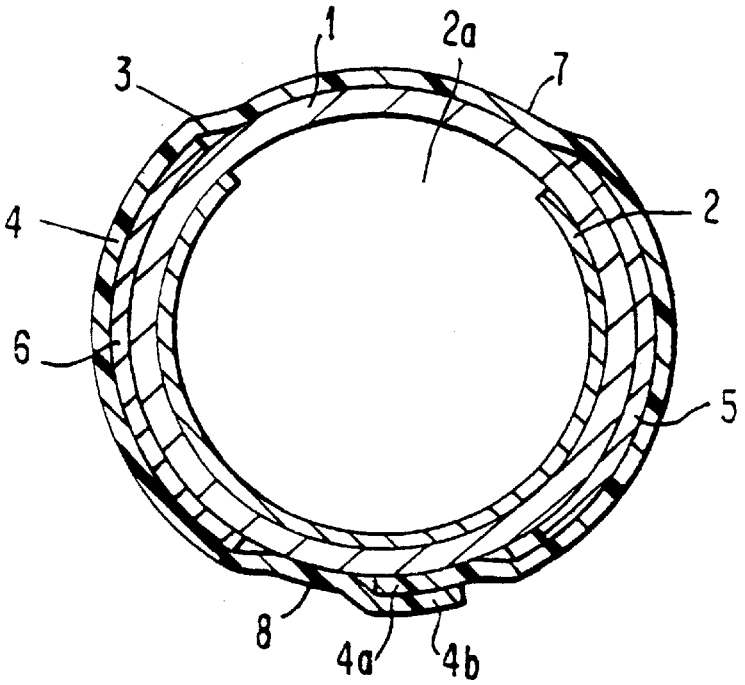
FIG. 8 PRIOR ART
FIG. 8 is a cross-sectional diagram showing the background noble gas discharge lamp.
Figure 9:
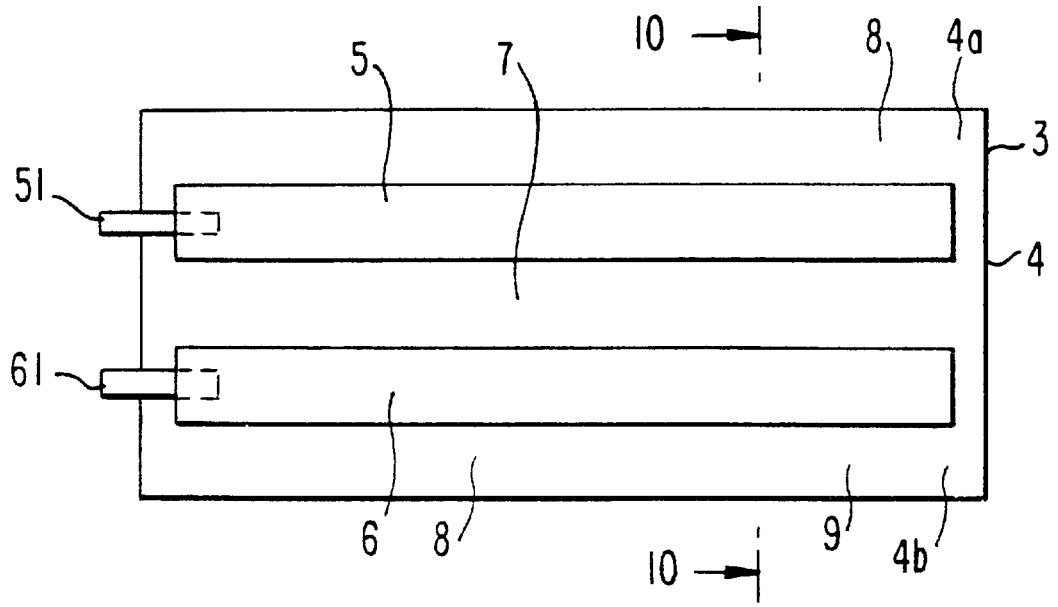
FIG. 9 PRIOR ART
FIG. 9 is a schematic view showing the outer laminate shown in FIG. 8.
Figure 10:
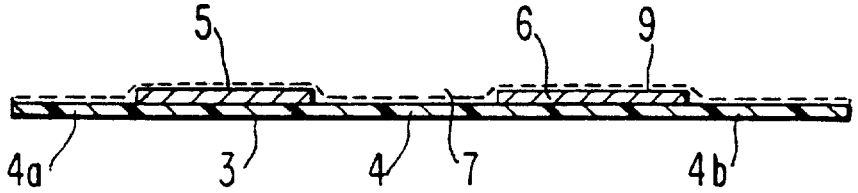
FIG. 10 PRIOR ART
FIG. 10 is a cross-sectional diagram taken along line X—X in FIG. 9.

The first embodiment of the noble gas discharge lamp of the present invention is explained below with reference to FIG. 1. The components in FIG. 1 identical to those in FIGS. 8 to 10 are numbered with the same reference numbers as in FIGS. 8 to 10, and detailed explanations thereof will be omitted.

Figure 1:
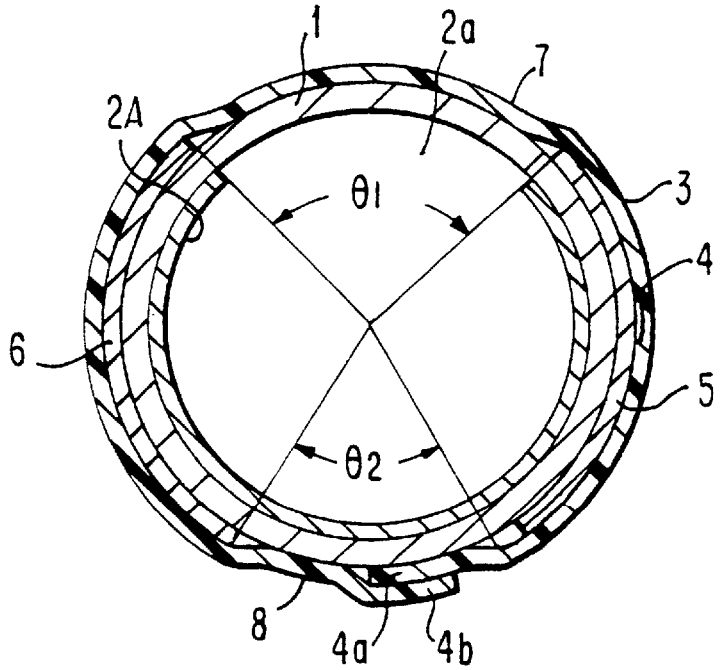
FIG. 1 is a cross-sectional diagram showing the noble gas discharge lamp of the first embodiment of the present invention.

The characteristic components of the noble gas discharge lamp shown in FIG. 1 are as follows:

A light emitting layer 2A comprising one or more kinds of fluorescent substances is formed inside of the outer enclosure 1A comprising a glass bulb (tube), for example. The coated amount of the fluorescent substance is set in a range of 5 to 30 mg/cm$^2$. The opening angle $\theta_1$ of the first opening portion 7 is larger than the opening angle $\theta_2$ of the second opening portion 8.

The opening angle $\theta_1$ of the first opening portion 7 is set in a range of 60° to 120°.

Moreover, the aperture 2*a* is formed in the inside of the outer enclosure 1A at a position corresponding nearly to the first opening portion 7, at which the light emitting layer 2A is not formed.

The outer enclosure 1A is comprised of materials having a large dielectric constant, reliable hermetic sealing properties, and light transmitting properties. However, it is preferable to use a lead glass having a large dielectric constant, for example.

The thickness of the outer enclosure 1A is set in a range of 0.2 to 0.6 mm. Excellent productivity and light properties can be obtained in this range. More specifically, when a high voltage of high frequency is applied to the outer electrodes 5 and 6, the increase of voltage to the outer enclosure 1A caused by increase of resistive components, can be prevented.

However, when the thickness of the outer enclosure 1A is less than 0.2 mm, the mechanical strength of the outer enclosure 1A is extremely decreased. Therefore, when the outer enclosures 1A are put into commercial production, the production rate of poor quality goods (broken glass, for example) increases. In contrast, when the thickness thereof is more than 0.6 mm, electric discharges in a striped pattern can be confirmed, Moreover, not only does the light emitting from the aperture 2*a* becomes very intermittent, but also the light output decreases, which is caused by inputting insufficient electrical power to the noble gas discharge lamp. Therefore, it is preferable that the thickness of the outer enclosure 1A be in that range.

The light emitting layer 2A may include one or more kinds of fluorescent substances, depending on the manner in which the noble gas discharge lamp is to be used.

Examples of the fluorescent substance comprising the light emitting layer 2A are fluorescent borate such as fluorescent europium activated yttrium·gallium borate, and the like; fluorescent phosphate such as fluorescent cerium·terbium activated lanthanum phosphate ($LaPO_4$:Ce, Tb), fluorescent tin activated strontium·magnesium phosphate ($(SrMg)_3(PO_4)_2$:Sn), fluorescent europium activated strontium boric phosphate ($2SrO\cdot(P_2O_7\cdot B_2O_3)$:Eu) and the like; fluorescent europium activated yttrium phosphovanadate ($Y(PV)O_4$:Eu); fluorescent cerium·terbium activated magnesium aluminate ($MgAl_{11}O_{19}$:Ce, Tb); fluorescent cerium·terbium activated yttrium·silicate ($Y_2SiO_5$:Ce, Tb); fluorescent europium activated barium·magnesium aluminate ($BaMg_2Al_{16}O_{27}$:Eu); fluorescent europium activated yttrium oxide ($Y_2O_3$:Eu), and the like.

More specifically, for instance, in the case of a three-wavelength illumination system, the light emitting layer 2A comprises a mixture of fluorescent substances, that is, fluorescent europium activated barium·magnesium aluminate having a blue emission spectrum; fluorescent cerium·terbium activated lanthanum phosphate having a green emission spectrum; and fluorescent europium activated yttrium·gallium borate having a red emission spectrum.

The coated amount of the fluorescent substance is set in a range of 5 to 30 mg/cm$^2$. In this range, the desired light output can be obtained. However, when the coated amount is less than 5 mg/cm$^2$, the light output decreases; therefore, the illumination intensity on the illuminated document is insufficient. In contrast, when the coated amount is more than 30 mg/cm$^2$, a light emitting layer 2A having uniform quality cannot be easily obtained. Therefore, the coated amount of the fluorescent substances is preferably in this range.

Moreover, the first and second opening portions 7 and 8 are formed at separated positions by the outer electrodes 5 and 6, and the opening angle $\theta_1$ of the first opening portion 7 is larger than the opening angle $\theta_2$ of the second opening portion 8.

Among the angles satisfying the above conditions, it is preferable that the opening angle $\theta_1$ of the first opening portion 7 be in the range of 60° to 120°, and the opening angle $\theta_2$ of the second opening portion 8 be approximately 55°. However, it is preferable that the second opening portion 8 be narrow so as not to cause breaks in insulation; therefore, the distance between one outer electrode 5 and the other electrode 6 in the second opening portion 8 is preferably 2 mm or more.

Moreover, the opening angle of the aperture 2*a* is equivalent to the first angle $\theta_1$ of the first opening portion 7, in the noble gas discharge lamp as shown in FIG. 1.

In this embodiment, the coated amount of the fluorescent substance is in a range of 5 to 30 mg/cm$^2$; the opening angle $\theta_1$ of the first opening portion 7 is larger than the opening angle $\theta_2$ of the second opening portion 8; and the opening angle $\theta_1$ of the first opening portion 7 is in a range of 60° to 120°; therefore, the light output from the first opening portion 7 via the aperture 2*a* can be effectively improved, without changing the size of the outer enclosure 1A or the electrical input. Therefore, when the noble gas discharge lamp of this example is used in an illumination device, for example, in office equipment, the illumination intensity on the illuminated document can be increased. As a result, even if the document feeding speed is increased, high accuracy of scanning can be maintained.

In particular, the above-mentioned range of the coated amount of the fluorescent substances is 2 to 10 times as much as the amount of the fluorescent substances employed in ordinary fluorescent lamps for illumination. It is believed that the coated amount is not preferable for ordinary fluorescent lamps for illumination. However, the light output is effectively increased in the noble gas discharge lamp of the embodiment. A cause of this phenomena is not clear; however, it may be believed that this phenomena is characteristic of noble gas discharge lamp in which innumerable discharges are formed between the outer electrodes 5 and 6 (approximately perpendicular to the longitudinal direction of the outer enclosure 1A); therefore, striped patterns are produced.

Moreover, the light output from the first opening portion 7 can be more effectively improved, by setting the coated amount of the fluorescent substance in the range of 5 to 30 mg/cm$^2$; by setting the opening angle $\theta_1$ of the first opening portion 7 in a range of 60 to 120°; and by applying the light reflective properties to the inside of the outer electrodes 5 and 6 in which the outer electrodes 5 and 6 contact with the outer enclosure 1A. In this way, the distance between one outer electrode 5 and the other electrode 6 in the second opening portion 8 is also set to 2 mm approximately, that is the opening angle $\theta_2$ of the second opening portion 8, is narrow (approximately 29°), it is anticipated that the loss of light leaking from the second opening portion 8 is prevented, and the light output from the first opening portion 7 is improved.

Figure 2:
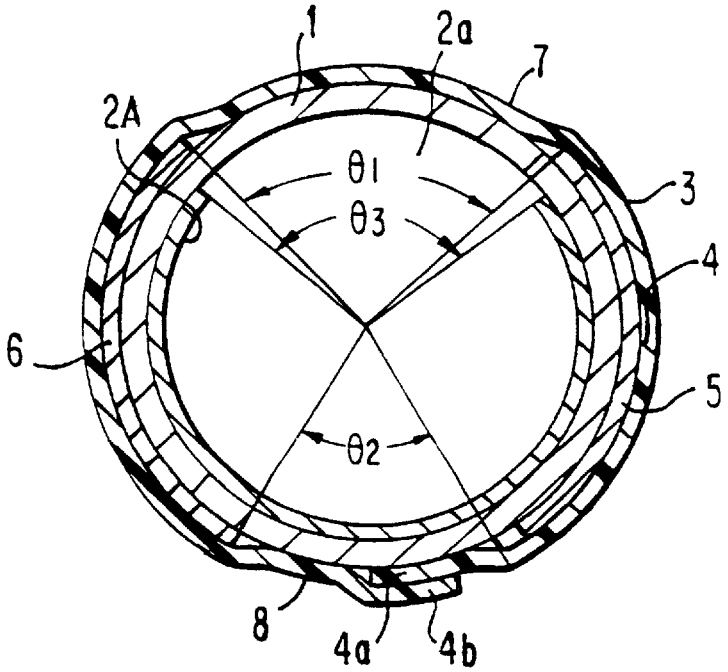
FIG. 2 is a cross-sectional diagram showing the noble gas discharge lamp of the second embodiment of the present invention.

FIG. 2 shows the second embodiment of the present invention, and the basic components of the noble gas discharge lamp shown in FIG. 2 are the same as those of the noble gas discharge lamp shown in FIG. 1.

However, they differ in the following point:

The opening angle $\theta_3$ of the aperture 2*a* formed in the inside of the outer enclosure 1A at the position corresponding to the first opening portion 7, is larger than the opening angle $\theta_1$ of the first opening portion 7.

The opening angle $\theta_3$ of the aperture 2*a* is set in a range of 70° to 130°, for instance; however, the angle $\theta_3$ can be changed depending on the situations or the objects of using the noble gas discharge lamp.

Moreover, the opening angle $\theta_1$ of the first opening portion 7 is larger than the opening angle $\theta_2$ of the second opening portion 8 in this embodiment.

In this embodiment, in winding the outer laminate 3 onto the outside of the outer enclosure 1A, even if the center of the first opening portion 7 is a little off-center with respect to the center of the aperture 2*a*, a discrepancy of the optical axis of the light emitted from the first opening portion 7 can be mitigated. Therefore, it is possible to obtain full scanning accuracy when the noble gas discharge lamp of the second embodiment is applied to an illumination device.

Figure 3:
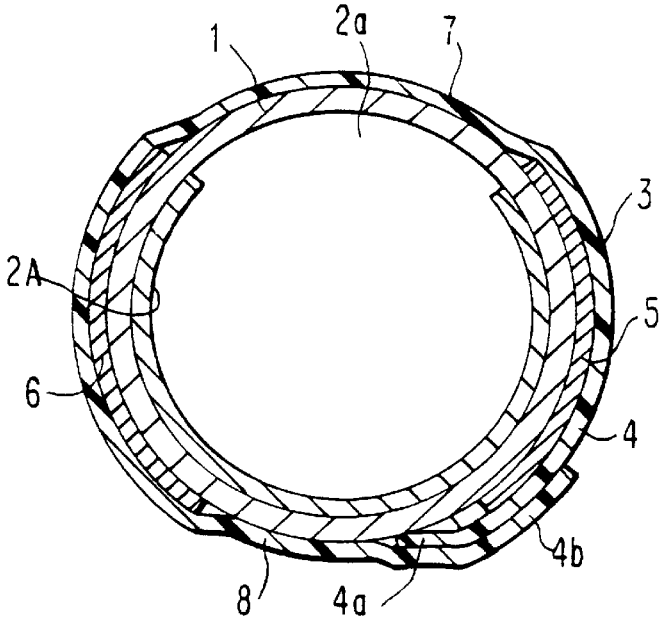
FIG. 3 is a cross-sectional diagram showing the noble gas discharge lamp of the third embodiment of the present invention.

FIG. 3 shows the third embodiment of the present invention, and the basic components of the noble gas discharge lamp shown in FIG. 3 are the same as those of the noble gas discharge lamp shown in FIG. 1.

However, they differ in following point:

One edge 4*a* and the other edge 4*b* of the light transmitting sheet 4 are laminated to each other on the outer electrode 5, and they are melted and adhered by ultrasonic waves.

In this embodiment, the laminated portions 4*a* and 4*b* are melted and adhered by ultrasonic waves on the outside of the outer electrode 5; therefore, an oscillation of ultrasonic waves applying the light emitting layer 2A positioning inside of the outer electrode 1A is relieved. In comparing the noble gas discharge lamps of the first and the second embodiments, the oscillation of ultrasonic waves applying the light emitting layer 2A positioning inside of the outer electrode 1A is relieved. As a result, a peeling off of the light emitting layer 2A from the outer enclosure 1A is substantially prevented, and light output can be improved.

Moreover, in the above embodiment, the laminated portions 4*a* and 4*b* of the light transmitting sheet 4 are melted and adhered by ultrasonic waves; however, adhesion by an adhesive agent, by heat, or simultaneous use of both may also be employed.

Figure 4:
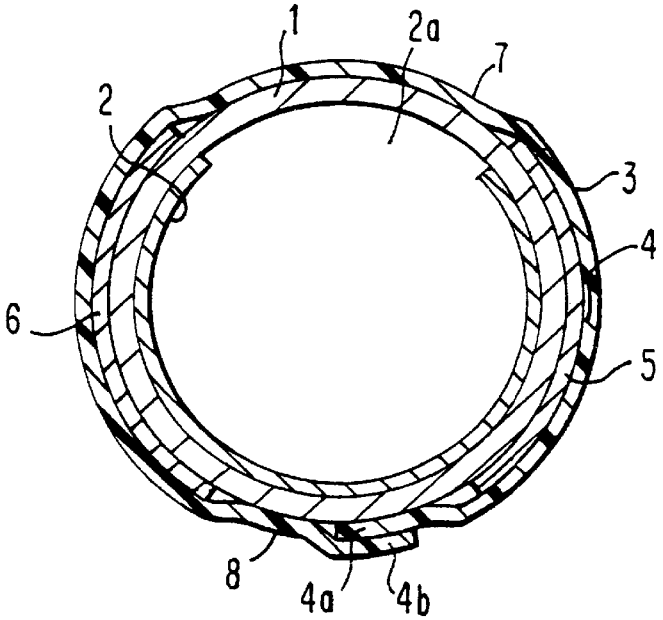
FIG. 4 is a cross-sectional diagram showing the noble gas discharge lamp of the fourth embodiment of the present invention.

FIG. 4 shows the fourth embodiment of the present invention, and the basic components of the noble gas discharge lamp shown in FIG. 4 are the same as those of the noble gas discharge lamp shown in FIG. 1.

However, they differ in the following point:

A pair of the outer electrodes 5 and 6 is adhered to the outside of the outer enclosure 1A by using the adhesive layer, then a light transmitting sheet 4A comprising PET resin and the like, for example, is wound on the outside of the outer enclosure 1A so as to cover the outer electrodes 5 and 6.

In this embodiment, the insulating ability between the outer electrodes 5 and 6 can be improved by forming an insulating coating having light transmitting properties, which is comprised of silicon varnish, to the outside of the outer enclosure 1A, before winding the light transmitting sheet 4A onto the outside of the outer enclosure 1A.

Figure 5:
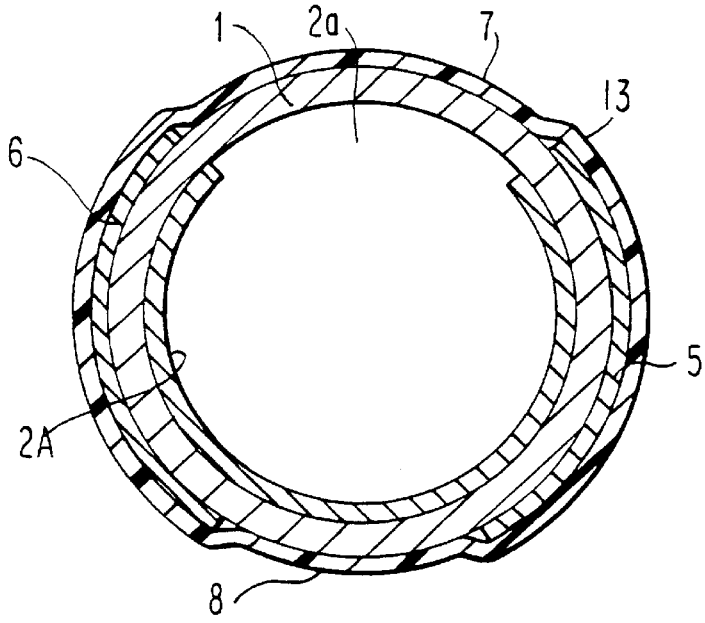
FIG. 5 is a cross-sectional diagram showing the noble gas discharge lamp of the fifth embodiment of the present invention.

FIG. 5 shows the fifth embodiment of the present invention, and the basic components of the noble gas discharge lamp shown in FIG. 5 are the same as those of the noble gas discharge lamp shown in FIG. 1.

However, they differ in the following point:

After a pair of outer electrodes 5 and 6 are adhered to the outside of the outer enclosure 1A using the adhesive layer, a protective tube 13 comprising thermal shrinking resin, such as PET resin and the like, is covered thereon and shrunk with heat so that the outer electrodes 5 and 6 are covered with the protective tube 13.

Moreover, after the protective tube 13 is fit to the outside of the outer enclosure 1A, the protective tube 13 can be forcibly contacted to the outside of the outer enclosure 1A by heating them to approximately 150 to 200° C., and the protective tube 13 is made to shrink by heat.

Compared to the above-mentioned embodiments, a manufacturing and working efficiency in this embodiment are not as good. However, because the adhesive layer is not used, erosion does not occur due to the reaction between the material comprising the terminals 51 and 61 and the adhesive composition comprised of the adhesive layer. Therefore, stable travel conditions in the noble gas discharge lamp can be maintained for long periods. In addition, the joint portion is not formed in the protective tube 13; therefore, for instance, the peeling of laminated portion of the light transmitting sheet 4 and 4A can be prevented as in the aforementioned embodiments.

In particular, the insulating ability between the outer electrodes 5 and 6 can be improved ore effectively by forming a insulating coating having light transmitting properties, which is comprised of silicon varnish, to the outside of the outer enclosure 1A, before covering the protective tube 13 over the outside of the outer enclosure 1A.

Figure 6:
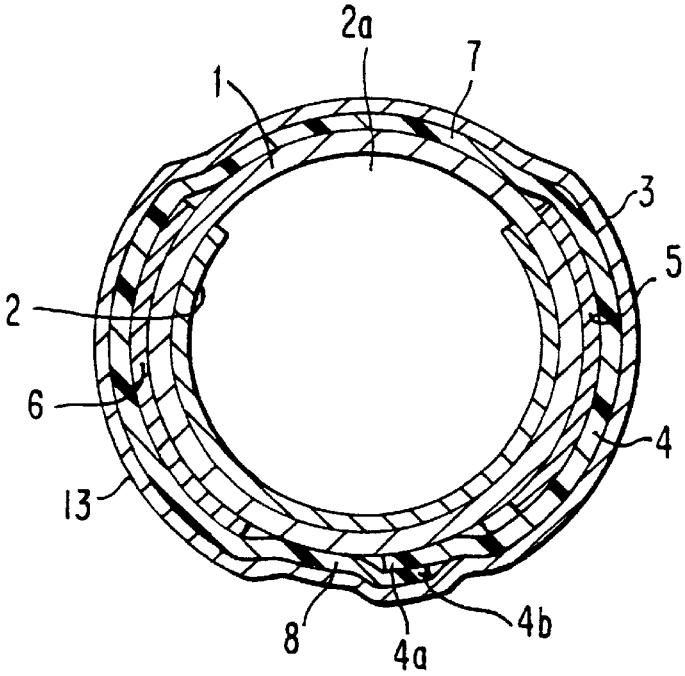
FIG. 6 is a cross-sectional diagram showing the noble gas discharge lamp of the sixth embodiment of the present invention.

FIG. 6 shows the sixth embodiment of the present invention, and the basic components the noble gas discharge lamp shown in FIG. 6 are the same as those of the noble gas discharge lamp shown in FIG. 1.

However, they differ in the following point:

After fitting a protective tube 13 over the outside of the outer laminate 3, which is comprised of thermal shrinking resins, such as PET resin, and the like, the protective tube 13 is made to shrink with heat.

Moreover, after the protective tube 13 is fit over the outside of the outer laminate 3 provided on the outside of the outer enclosure 1A, the protective tube 13 can be contacted forcibly to the outside of the light transmitting sheet 4 by heating them to approximately 150° C. to 200° C., and the protective tube 13 is made to shrink by heat.

In this embodiment, even if the noble gas discharge lamp is used under extreme conditions, or in situations requiring the high safety standards, products having high quality can be produced by covering the outer laminate 3 with protective tube 13 having high heat-resistance and light transmitting properties.

In particular, the characteristic structure of this embodiment can be applied to the noble gas discharge lamps shown in FIGS. 2, 3, 5 and 7.

Figure 7:
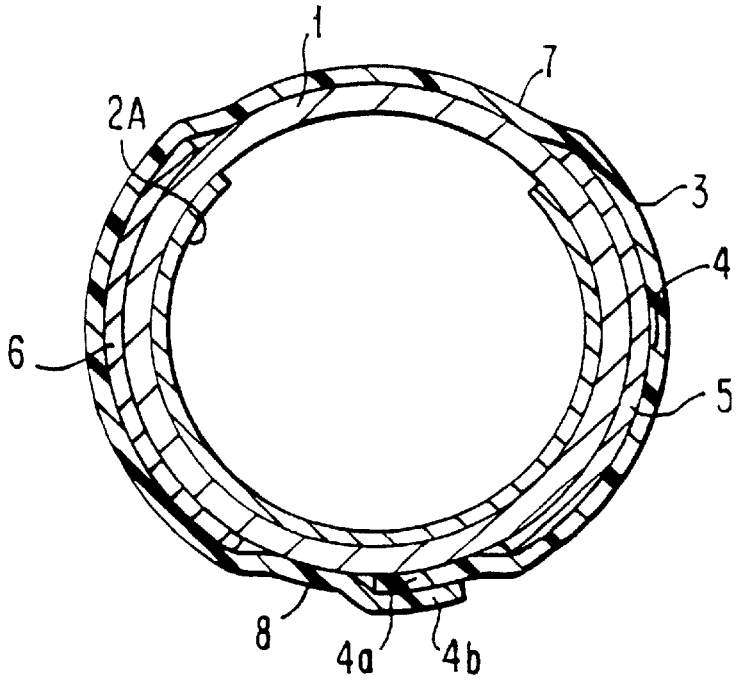
FIG. 7 is a cross-sectional diagram showing the noble gas discharge lamp of the seventh embodiment of the present invention.

FIG. 7 shows the seventh embodiment of the present invention, and the basic components of the noble gas discharge lamp shown in FIG. 7 are the same as those of the noble gas discharge lamp shown in FIG. 1.

However, they differ in the following point:

The light emitting layer 2A is formed over the entire inside of the outer enclosure 1A, that is, the aperture 2*a* is not formed at the position corresponding to the first opening portion 7.

In this embodiment, it is not necessary to match the positions of the aperture 2*a* and the first opening portion 7 formed by the outer electrodes 5 and 6; therefore, the operation can be performed efficiently by winding the outer laminate 3 around the outside of the outer enclosure 1A.

EXPERIMENTAL EXAMPLES

The present invention will now be explained using experimental examples.

EXPERIMENTAL EXAMPLE 1

The fluorescent water-soluble coating solution having below composition was obtained.

Fluorescent europium activated barium·magnesium aluminate having an emission spectrum in blue wavelengths 65 weight % Fluorescent cerium·terbium activated lanthanum phosphate having an emission spectrum in green wavelengths 15 weight % Fluorescent europium activated yttrium·gallium borate having an emission spectrum in red wavelengths 20 weight %

Next, the light emitting layer 2A was formed by coating the obtained fluorescent water-soluble coating solution on the inside of the outer enclosure 1A comprised of lead glass, which was 8 mm in external diameter, 0.5 mm in thickness, and 360 mm in length.

Then, the aperture having 75° in the opening angle was obtained by forcibly peeling off a part of the obtained light emitting layer 2A using a scraper.

Figure 11:
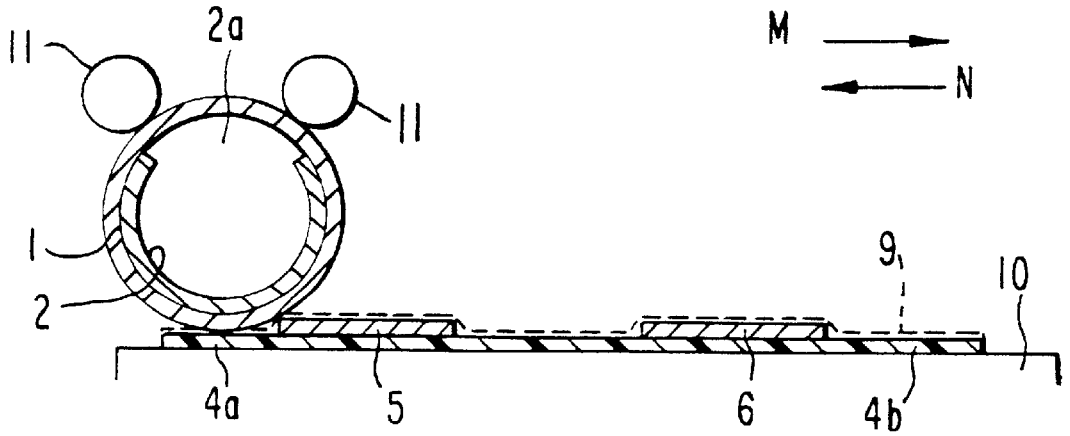
FIG. 11 PRIOR ART
FIG. 11 is a schematic view showing the process for producing the noble gas discharge lamp shown in FIG. 8.
Figure 12:
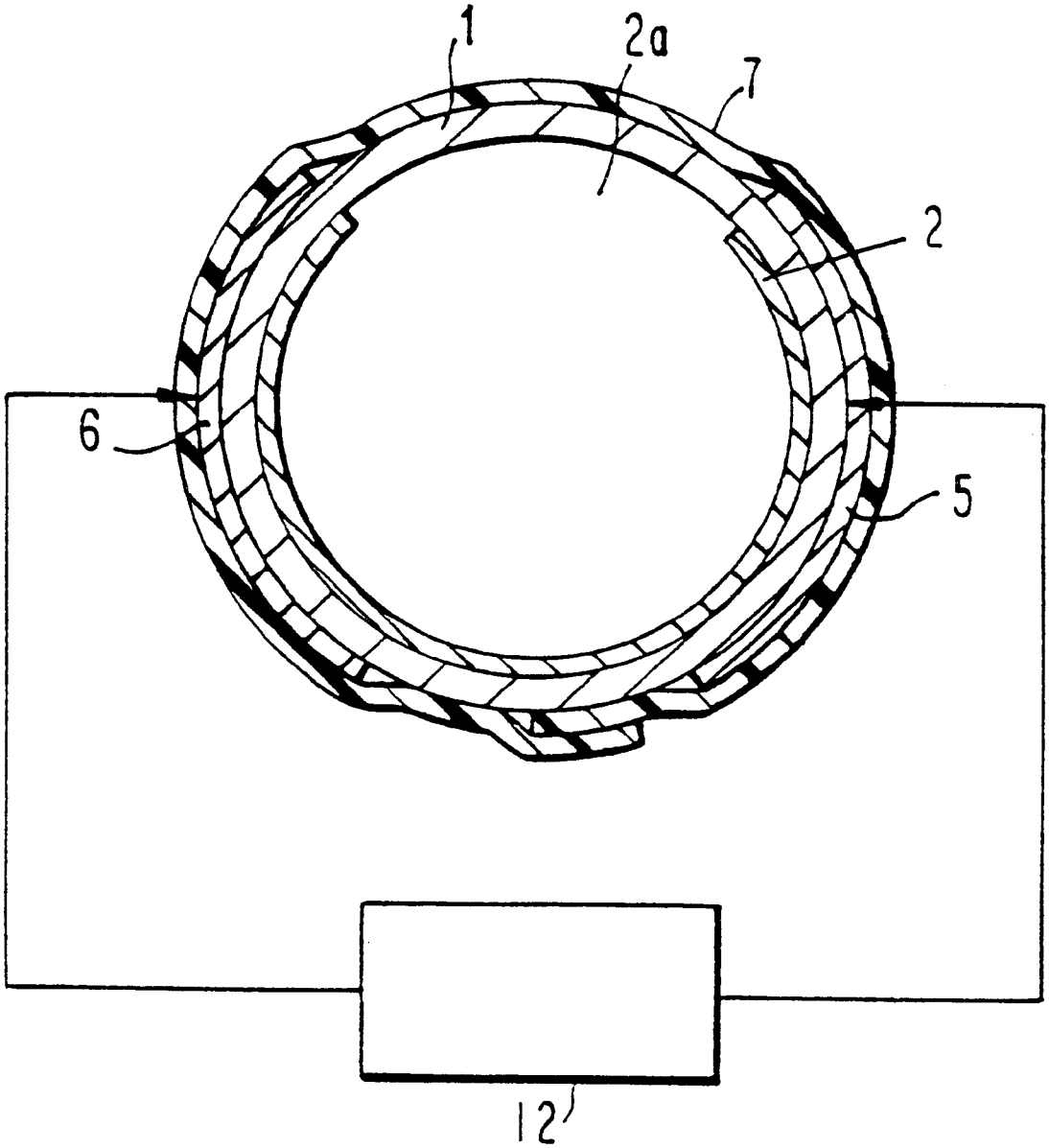
FIG. 12 PRIOR ART
FIG. 12 is a schematic view showing an electric circuit of noble gas discharge lamp.

Moreover, the coating amount of the fluorescent water-soluble coating solution was varied in a rage of 3 to 35 mg/cm$^2$, as shown in the following Table 1. The noble gas discharge lamps were produced by the same steps shown in FIG. 11. In this Experimental Example, the opening angle of the first opening portion 7 was set to 75° and the opening angle of the second opening portion 8 was set to 55°.

Next, the following measurements were carried out for the noble gas discharge lamps obtained in this Experimental Example.

(1) The illumination intensity on the document

The obtained noble gas discharge lamps were incorporated in an electric circuit, and the output voltage (frequency fixed at 30 kHz) of the inverter circuit 12 were set to 90% of a fixed voltage (2500 $V_{o\text{-}p}$). In these conditions, the illumination intensities on a document were measured at a point 8 mm away from the outer enclosure.

In Table 1, ○ means that the illumination intensity of the document is 9000 (Lx) or greater, Δ means that the value is 8500 (Lx) or greater and less than 9000 (Lx), and x means that the value is less than 8500 (Lx).

(2) Simplicity Degree of coating (Simplicity Degree of forming the light emitting layer 2A)

In Table 1, ○ means that it was easy to coat the fluorescent water-soluble coating solution inside the outer enclosure, Δ means that there was some difficulty but no impediment in coating, and X means that coating was difficult.

TABLE 1

| Coating amount (mg/cm$^2$) | Illumination intensity on the document (Lx) | Simplicity Degree of coating |
|---|---|---|
| 3 | X | ○ |
| 5 | Δ | ○ |
| 10 | ○ | ○ |
| 15 | ○ | ○ |
| 20 | ○ | ○ |
| 25 | ○ | ○ |
| 30 | ○ | Δ |
| 35 | Δ | X |

As shown in Table 1, the following points were clear.

When the coating amount of the fluorescent water-soluble coating solution is in a range of 10 to 30 mg/cm$^2$, sufficient illumination intensity of the document can be achieved, and the noble gas discharge lamps were in useful.

In the cases of 5 mg/cm$^2$ and 35 mg/cm$^2$, the noble gas discharge lamps were useful, but some illumination intensities were decreased.

In the case of 3 mg/cm$^2$, the noble gas discharge lamps were not useful.

When the noble gas discharge lamp has 25 mg/cm$^2$ or less of a coating amount, a satisfactory light emitting layer 2A can be formed; therefore, the noble gas discharge lamps were useful.

In the case of 30 mg/cm$^2$, the noble gas discharge lamp can be used in practice without difficulty; however, it is somewhat difficult to coat the fluorescent water-soluble coating solution.

In the case of 35 mg/cm$^2$, the noble gas discharge lamp comprising the light emitting layer 2A having uniform quality, cannot be obtained.

Therefore, as shown in Table 1, it is preferable that the coating amount of the fluorescent water-soluble coating solution for making the light emitting layer 2A be in the range of 5 mg/cm$^2$ to 3 mg/cm$^2$.

EXPERIMENTAL EXAMPLE 2

Noble gas discharge lamps were produced in which the coating amount of the fluorescent water-soluble coating solution for making the light emitting layer 2A (this solution is the same as that used in the experimental example 1) was set to 15 mg/cm$^2$ The thickness of the outer enclosure 1A was varied in a range of 0.18 to 0.8 mm, as shown in the following Table 2.

Moreover, the opening angle $\theta_1$ of the first opening portion 7 was set to 75°, and the opening angle $\theta_2$ of the second opening portion 8 was set to 55°.

Next, the following measurements were carried out for the noble gas discharge lamps obtained in the Experimental Examples.

(1) Illumination intensity of the document

The obtained noble gas discharge lamps were incorporated in an electric circuit, and the output voltage (frequency fixed at 30 kHz) of the inverter circuit 12 were set to 90% of a fixed voltage (2500 $V_{o\text{-}p}$). In these conditions, the illumination intensities on the document were measured at a point 8 mm away from the outer enclosure.

In Table 2, ○ means that the illumination intensity on the document is 9000 (Lx) or greater, Δ means that the value is 8500 (Lx) or greater and less than 9000 (Lx), and X means that the value is less than 8500 (Lx).

(2) Occurrence of the intermittent illumination

The occurrence of intermittent illumination was evaluated.

In Table 2, ○ means that intermittent illumination did not occur, and X means that intermittent illumination did occur.

(3) Presence of damage in producing steps (Strength)

In production steps, the presence of damage in the outer enclosures 1A of the obtained noble gas discharge lamps was evaluated.

In Table 2, ○ means that damage to the outer enclosure were not observed, and the strength of the outer enclosure is sufficient; Δ means that some damage was observed in the outer enclosure, but the noble gas discharge lamps comprising the outer enclosures were at least usable; and X means that serious damage to the outer enclosure was observed and the strength of the outer enclosure meant the produced lamps would be difficult to use.

TABLE 2

| Thickness of the outer enclosure (mm) | Illumination intensity on the document (Lx) | Occurrence of intermittent illumination | Strength |
|---|---|---|---|
| 0.18 | ○ | ○ | X |
| 0.2 | ○ | ○ | Δ |
| 0.25 | ○ | ○ | Δ |
| 0.5 | ○ | ○ | ○ |
| 0.6 | Δ | ○ | ○ |
| 0.7 | X | X | ○ |
| 0.8 | X | X | ○ |

As shown in Table 2, the following points were clear.

Regarding to the illumination intensity on the document, the following points were clear.

When the thickness of the outer enclosure is in a range of 0.18 to 0.5 mm, sufficient illumination intensity on the document can be obtained.

When the thickness is 0.6 mm, some illumination intensities decreased.

When the thickness is 0.7 mm or greater, the illumination intensities substantially decreased. It is believed that the decrease is caused by increase of resistant components.

Regarding the presence of the intermittent illumination, when the thickness is in a range of 0.18 to 0.6 mm, although, the output power is weak, intermittent illumination cannot be confirmed.

When the thickness is 0.7 mm or greater, intermittent illumination can be confirmed.

Regarding presence of damages in producing steps, the following points were clear.

When the thickness of the outer enclosure is 0.5 mm or greater, damage cannot be confirmed in the producing steps.

When the thickness is less than 0.4 mm, especially 0.25 mm and 0.2 mm, damage was observed. In additionally, when the thickness is less than 0.18 mm, damage suddenly increases; therefore, it is confirmed that when the outer enclosures have thickness of 0.18 mm or less, mechanical strength is low, and they are unsuitable for producing in large quantities.

Therefore, as shown in Table 2, the thickness of the outer enclosure is preferably in a range of 0.2 to 0.6 mm, more preferably in a range of 0.4 to 0.6 mm.

EXPERIMENTAL EXAMPLE 3

Noble gas discharge lamps were produced, in which the coating amount of the fluorescent water-soluble coating solution for making the light emitting layer 2A (this solution is the same as that used in the experimental example 1) was 15 mg/cm$^2$, the width of the outer electrodes 5 and 6 was fixed to 8 mm, the thickness of the outer enclosure IA was fixed to 0.5 mm, the opening angle $\theta_3$ of the aperture 2*a* was fixed to 75°, and the opening angle $\theta_1$ of the first opening portion 7 was varied in a range of 50° to 105°, as shown in Table 3.

Moreover, the distance between the outer electrodes becomes larger in proportion to the increase of the opening angle $\theta_1$, and the distance between the outer electrodes 5 and 6 becomes smaller in proportion to the decrease of the opening angle $\theta_1$.

Next, the following measurements were carried out for the noble gas discharge lamps obtained in this Experimental Examples.

(1) Illumination intensity on the document

The obtained noble gas discharge lamps were incorporated in the electric circuit, and the output voltage (frequency is fixed at 30 kHz) of the inverter circuit 12 were set to 90% of fixed voltage (2500 $V_{o\text{-}p}$). In these conditions, the illumination intensities of the document were measured at a point 8 mm away from the outer enclosure.

In Table 3, ○ means that the illumination intensity of the document is 9000 (Lx) or greater, Δ means that the value is 8500 (Lx) or greater and less than 9000 (Lx), and X means that the value is less than 8500 (Lx).

(2) Occurrence of dielectric breakdown

The occurrence of dielectric breakdown between the outer electrodes 5 and 6 (in the second opening portion 8) was evaluated.

In Table 3, ○ means that the dielectric breakdowns did not occur; Δ means that the dielectric breakdowns occurred rarely, but the noble gas discharge lamps comprised of the outer enclosures can be at least useful; and X means that the dielectric breakdowns occur often.

TABLE 3

| Opening Angle $\Theta_1$ (°) | Illumination intensity on the document (Lx) | Occurrence of dielectric breakdown |
|---|---|---|
| 50 | X | ○ |
| 55 | X | ○ |
| 60 | Δ | ○ |
| 70 | ○ | ○ |
| 80 | ○ | ○ |
| 90 | ○ | ○ |
| 95 | ○ | Δ |
| 100 | ○ | Δ |
| 105 | ○ | X |

As shown in Table 3, the following points were clear.

When the opening angle $\theta_1$ of the first opening portion 7 is in the range of 65° to 105° the sufficient illumination intensity of the document can be obtained.

In the case of 60°, some illumination intensities were decreased.

In the case of 55° or less, the illumination intensities were substantially decreased. It is believed that this decrease occurred because the distance between the outer electrodes is fixed therfore, the opening angle $\theta_2$ of the second opening portion 8 becomes relatively relatively large: when the opening angle $\theta_1$ of the first opening portion 7 becomes small.

As a result, the light leaks from the second opening portion 8; therefore, the light intensity from the first opening portion 7 decreases.

The dielectric breakdown in the second opening was not observed in the noble gas discharge lamp having 90° or less of the opening angle $\theta_1$ of the first opening portion 7.

In the cases of 95° and 100°, some dielectric breakdown in the second opening can be observed.

When the opening angle $\theta_1$ of the first opening portion 7 is 105°, the dielectric breakdowns occurred frequently, it is difficult to maintain high quality of the noble gas discharge lamp.

Moreover, in the cases in which the opening angles $\theta_1$ of the first opening portion 7 are 100° and 105°, the distance between the outer electrodes, that is, the length of the second opening in the outer enclosure, were respectively 2.1 mm and 1.7 mm.

Therefore, as shown in Table 3, when the distance between the outer electrodes is fixed, it is preferable that the opening angles $\theta_1$ of the first opening portion 7 be set in the range of 60 to 100°, and the length of the second opening in the outer enclosure is approximately 2 mm or greater.

EXPERIMENTAL EXAMPLE 4

Noble gas discharge lamps were produced in which the coating amount the fluorescent water-soluble coating solution for making the light emitting layer 2A (this solution is the same as that used in the experimental example 1) was 15 mg/cm$^2$, the distance between the outer electrodes 5 and 6 along the outer enclosure 1A in the second opening portion 8 was fixed at 2 mm, the opening angle $\theta_3$ of the aperture 2*a* was fixed at 75°, the thickness of the outer enclosure 1A was fixed to 0.5 mm, and the opening angle $\theta_1$ of the first opening portion 7 was varied in a range of 50° to 140°, as shown in Table 4.

Moreover, the distance between the outer electrodes 5 and 6 becomes larger in proportion to the increase of the opening angle $\theta_1$, and the distance between the outer electrodes 5 and 6 becomes smaller in proportion to the decrease of the opening angle $\theta_1$.

Next, the following measurement was carried out on noble gas discharge lamps obtained in this Experimental Example.

(1) Illumination intensity on the document

The obtained noble gas discharge lamps were incorporated in an electric circuit, and the output voltage (frequency fixed at 30 kHz) of the inverter circuit 12 was set to 90% of fixed voltage (2500 $V_{o\text{-}p}$) In these conditions, the illumination intensities of the document were measured at a point 8 mm away from the outer enclosure.

In Table 4, ○ means that the illumination intensity of the document is 9000 (Lx) or greater, Δ means that the value is 8500 (Lx) or greater and less than 9000 (Lx), and X means that the value is less than 8500 (Lx).

TABLE 4

| Opening Angle $\Theta_1$ (°) | Illumination intensity on the document (Lx) |
|---|---|
| 50 | X |
| 60 | Δ |
| 70 | ○ |
| 80 | ○ |
| 90 | ○ |
| 100 | ○ |
| 110 | Δ |
| 120 | Δ |
| 130 | X |
| 140 | X |

As shown in Table 4, the following points were clear.

When the opening angle $\theta_1$ of the first opening portion 7 is in a range of 70° to 100°, sufficient illumination intensity of the document can be obtained.

In the cases of 60°, and a range of 110° to 120°, some illumination intensities were decreased.

In the cases of 50°, and a range of 130° to 140°, the illumination intensities were decreased substantially.

In particular, when the opening angle $\theta_1$ of the first opening portion 7 is in the range of 130° to 140°, sufficient electric power cannot be obtained because the distance between the outer electrodes is narrow; therefore, illumination intensities decrease substantially.

When the opening angle $\theta_1$ of the first opening portion 7 is in a range of 110° to 120°, some illumination intensity on the document decreased. It is believed that this decrease is caused for the same reason as in the opening angle $\theta_1$ of the first opening portion 7 is in a range of 130° to 140°.

Therefore, as shown in Table 4, when the distance between the outer electrodes in the second opening portion 8 is fixed, it is preferable that the opening angles $\theta_1$ of the first opening portion 7 is set in the range of 60° to 100°.

What is claimed is:

1. A noble gas discharge lamp comprising of:

an outer enclosure comprising a light emitting layer comprising at least one fluorescent substance, the light emitting layer formed therein, and a pair of outer electrodes having tape shapes comprise a metal, which are adhered to the entire length of the outside of the outer enclosure so as to separate one outer electrode and the other outer electrode at a certain distance, and to form a first opening portion and a second opening portion;

wherein the coated amount of fluorescent substance is in a range of 5 to 30 mg/cm$^2$.

2. A noble gas discharge lamp according to claim 1, wherein the thickness of the outer enclosure is in a range of 0.2 to 0.6 mm.

3. A noble gas discharge lamp according to claim 2, wherein an insulating material is coated on the outside of the outer enclosure so as to cover the outer electrodes.

4. A noble gas discharge lamp according to claim 1, wherein an aperture is formed in the inside of the outer enclosure at a position corresponding to the first opening portion, in which the light emitting layer is not formed.

5. A noble gas discharge lamp according to claim 4, wherein an opening angle $\theta_1$ of the first opening portion is larger than an opening angle $\theta_2$ of the second opening portion.

6. A noble gas discharge lamp according to claim 5, wherein an opening angle $\theta_3$ of the aperture is larger than an opening angle $\theta_1$ of the first opening portion, and the light emitting layer is formed so as that a boundary line between the aperture and the light emitting layer does not extend into the first opening portion.

7. A noble gas discharge lamp according to claim 6, wherein the opening angle $\theta_1$ of the first opening portion is in a range of 60 to 120°.

8. A noble gas discharge lamp according to claim 7, wherein the distance between one outer electrode and the other electrode in the second opening portion is at least 2 mm.

9. A noble gas discharge lamp according to claim 1, wherein light reflective properties are applied to the inside of the outer electrodes in which the outer electrodes contact with the outer enclosure.

10. A noble gas discharge lamp according to claim 2, wherein the insulating material is at least one material selected from the group consisting of a protective tube comprising thermal shrinking resin and a light transmitting sheet.

* * * * *